US011274486B2

(12) United States Patent
Ladani et al.

(10) Patent No.: US 11,274,486 B2
(45) Date of Patent: Mar. 15, 2022

(54) AUTOMATED SYSTEM FOR OPENING AND CLOSING SLIDING DOORS AND WINDOWS

(71) Applicants: Shruti Narottambhai Ladani, Newark, CA (US); Hemal Rameshbhai Meghpara, Newark, CA (US)

(72) Inventors: Shruti Narottambhai Ladani, Newark, CA (US); Hemal Rameshbhai Meghpara, Newark, CA (US)

( * ) Notice: Subject to any disclaimer, the term of this patent is extended or adjusted under 35 U.S.C. 154(b) by 308 days.

(21) Appl. No.: 16/399,891

(22) Filed: Apr. 30, 2019

(65) Prior Publication Data

US 2020/0347660 A1 Nov. 5, 2020

(51) Int. Cl.

*E05F 15/632* (2015.01)
*E05F 15/643* (2015.01)
*E05F 15/635* (2015.01)

(52) U.S. Cl.

CPC ..... *E05F 15/643* (2015.01); *E05F 15/632* (2015.01); *E05F 15/635* (2015.01); *E05Y 2201/41* (2013.01); *E05Y 2201/422* (2013.01); *E05Y 2900/132* (2013.01); *E05Y 2900/148* (2013.01)

(58) Field of Classification Search

CPC ..... E05F 15/643; E05F 15/635; E05F 15/632; E06B 3/46; E05Y 2201/422; E05Y 2201/41; E05Y 2900/148; E05Y 2900/132

See application file for complete search history.

(56) References Cited

U.S. PATENT DOCUMENTS 2,132,325 A * 10/1938 Soldatti ..... E05F 15/57 49/360
2,320,413 A 6/1943 Cummings
2,835,487 A * 5/1958 Clark ..... F25D 23/021 49/139
2,843,375 A * 7/1958 Lesage ..... E06B 3/4645 49/220
2,878,532 A * 3/1959 Clark ..... E05D 15/1021 49/139
2,927,788 A * 3/1960 Slopa ..... E05F 15/643 49/27
2,979,328 A 4/1961 Henriksen
3,166,155 A * 1/1965 Clark ..... E05F 1/006 49/7
3,223,402 A 12/1965 Glenn
4,296,570 A 10/1981 Balbach et al.
4,698,938 A * 10/1987 Huber ..... F16H 25/2018 49/138

(Continued)

FOREIGN PATENT DOCUMENTS

EP 2 362 046 81 8/2011

*Primary Examiner* — Justin B Rephann
(74) *Attorney, Agent, or Firm* — Ariel S. Bentolila; Bay Are IP Group, LLC

(57) ABSTRACT

A system comprising an opening comprising a door or a window, wherein the opening comprises a door or a window frame is provided. The opening comprises at least one movable door panel or at least one movable window panel based on if the opening is the door or the window respectively. The system also comprises a deadbolt inbuilt in the door panel or the window panel, a guiding device and a mechanical moving mechanism, wherein the guiding device and the mechanical moving mechanism are both housed in a guiding device housing, a guide block, and an attachment mechanism.

17 Claims, 18 Drawing Sheets

(56) References Cited

U.S. PATENT DOCUMENTS 4,927,198 A * 5/1990 Fennell ..... E05B 65/0888 16/66
5,269,098 A 12/1993 Redman
5,410,842 A * 5/1995 Watson ..... E05F 15/56 49/360
5,826,377 A * 10/1998 Simson ..... E05D 15/066 49/362
6,481,161 B1 11/2002 Thurher
9,003,705 B1 * 4/2015 Solowiej ..... E06B 7/32 49/169
9,038,317 B2 5/2015 Hansen
9,797,182 B2 10/2017 Raap et al.
10,119,319 B2 * 11/2018 Ritt ..... E05D 15/1068
10,378,266 B2 * 8/2019 Walden ..... E05F 15/77
10,718,150 B2 * 7/2020 Hall ..... E05F 15/635
10,822,857 B2 * 11/2020 Hall ..... E05F 15/77
10,829,977 B2 * 11/2020 Bernhagen ..... E05F 15/641
2005/0198901 A1 * 9/2005 Solowiej ..... A01K 1/035 49/167
2007/0011946 A1 1/2007 Mullen et al.
2007/0271850 A1 * 11/2007 Mickelson ..... E05D 15/565 49/358
2008/0060276 A1 * 3/2008 Speyer ..... E06B 7/16 49/495.1
2008/0163553 A1 7/2008 Liao
2009/0025296 A1 1/2009 Petner
2009/0199491 A1 * 8/2009 Boldt ..... E05D 15/0621 52/64
2010/0332034 A1 12/2010 Bergeson et al.
2012/0137584 A1 * 6/2012 Thomas ..... E05D 13/14 49/13
2012/0192490 A1 * 8/2012 Mccaslin ..... H04L 12/2827 49/31
2013/0318875 A1 * 12/2013 Hansen ..... E05F 15/665 49/349
2014/0047768 A1 * 2/2014 Vaknin ..... E05B 47/02 49/25
2014/0232120 A1 8/2014 Wolf
2015/0152676 A1 * 6/2015 Plummer ..... E05C 1/08 49/280
2015/0267456 A1 * 9/2015 Shih ..... E05F 15/57 49/349

* cited by examiner

AUTOMATED SYSTEM FOR OPENING AND CLOSING SLIDING DOORS AND WINDOWS

CROSS-REFERENCE TO RELATED APPLICATIONS

Not applicable

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to door and window systems. More particularly, certain embodiments of the invention relate to sliding door and window systems.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that many buildings and homes have manually or automatically operated sliding doors. Many of the sliding doors used in commercial settings are designed with elaborate sliding door systems to automatically open when approached and close after a period of time. Automatically controlled power-driven sliding doors are also in wide use for entry into buildings, rooms, vehicles and the like. The extensive use of sliding doors is fostered by their intrinsic utility and convenience as well as their space-saving features. Since a sliding door may operate in the plane of an entrance, problems of providing additional space for a swinging door, as well as potential contact with transistors by a swinging door are avoided. Accordingly, there is a need for an automatic door closure device that may be easily installed on a preexisting sliding door in household settings that is not obtrusive to the aesthetic appearance of a sliding door entry. It may also be desirable for such automatic door closure devices to allow for easy manual operation or other types of added safety measures in case of an emergency, power failure, etc.

In addition, various devices are known in the art to operate sliding or folding automatic doors. Typically, these operating assemblies may be provided overhead. In some instances, these overhead assemblies may not fit within a given fenestration in a building because of building code requirements for minimum door opening heights. Further, overhead assemblies are aesthetically unpleasing. It may be desirable to have an operating system that is configured for installation either below or within a floor surface or an adjacent wall in order to meet building code requirements, at the same time, provide an aesthetically pleasing door or window system.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
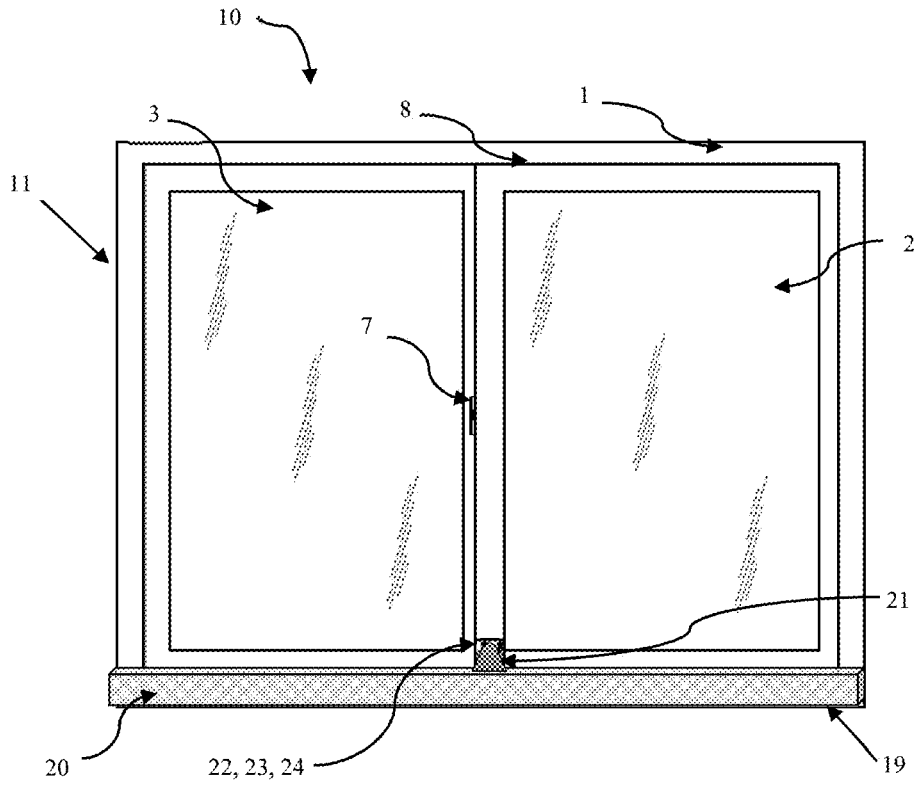
FIG. 1 is an illustration of an exemplary sliding window/door system, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v.

Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, are generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components is described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention and variations thereof, relate to sliding opening systems, i.e., sliding window opening systems and sliding door opening systems. In one embodiment of the present invention, the sliding opening system may include a door/window, a door/window frame, a horizontal sliding door/window panel, a deadbolt (latch) inbuilt in the door/window panel, a guiding device, a guiding device housing i.e., an outer casing, a mechanical moving mechanism including a combination of at least one of the following including, but not limited to, a motorized mechanism/lead screw and sensors/circuit, a belt/chain mechanism and sensors/circuit, and a hydraulic cylinder mechanism and sensor/circuit, a guide/control block, and an attachment mechanism. In one exemplary embodiment the sliding opening system may also include a fixed door/window panel. It will be appreciated by a person with ordinary skill in the art, in light of and in accordance with the teachings of the present invention, that in some embodiments any of the panels may be rendered fixed or movable as long as the guiding device is able to perform the required function as disclosed herein. In one exemplary embodiment, the right panel of a door or window panel is the movable panel and the left panel of the door or window panel is the fixed panel. In one embodiment, the guiding device and the mechanical moving mechanism are both housed in a guiding device housing. In one embodiment, the door/window frame may be secured in a wall comprising of moving and fixed parts. In one embodiment, the door/window frame may contain frame guide channels for the movable panel and hold the fixed panel. In various embodiments, the movable panel may open or close either while sliding horizontally or moving vertically on a frame guide channel. In one embodiment, the fixed panel of the door/window may be fixed to the frame. It will be appreciated by a person with ordinary skill in the art, in light of and in accordance with the teachings of the present invention, that the deadbolt or latch type lock may be inbuilt in a majority of sliding opening systems to block the movable panel from opening at the outside when in a closed and locked position. The deadbolt may be kept in an unlocked position to allow the movable panel attached with the guide block to be controlled with the guiding device. The deadbolt may comprise a latch type lock which may serve the functionality of a deadbolt/latch when the movable panel is closed and attached with the guide block, thereby keeping the deadbolt/latch in an open position.

In an exemplary embodiment, the guiding device may comprise a motorized mechanism including a lead screw, and/or other modules like control circuitry, power source, and sensors to generate the force necessary to move the movable panel 2 (as described herein below with reference go FIG. 18). The guiding device may move the guide block back and forth along the length of the guiding device. Force is transferred via the guide block to the movable panel via the attachment mechanism. The guide block may be coupled to the motorized mechanism inside the guiding device. When the motor rotates, it moves the guide block back and forth based on a direction of rotation of the motor.

In another embodiment, a guiding device may be attached to pre-existing window/door panels. The guiding device may comprise a guiding device housing, a combination of at least one of the following including, but not limited to, a motorized mechanism/lead screw and sensors/circuit, a belt/chain mechanism and sensors/circuit, and a hydraulic cylinder mechanism and sensor/circuit, a guide/control block, and an attachment mechanism. The attachment mechanism may comprise a pin implement, a hole portion, and a mounting face plate implement. In one embodiment, the pin implement and the mounting face plate implement may be disposed on a side corner of a movable panel of a pre-existing window/door panel while the he hole portion may be disposed in the guide/control block wherein the movable panel may be detached and/or attached with the pin implement that is pushed or pulled by hand. In another embodiment, the pin implement and the mounting face plate implement may be attached on the guide block while the hole portion may be disposed on a side corner of the movable panel. The movable panel may be detached and/or attached with the guide block using the pin implement that is pushed or pulled by hand.

In additional embodiments, the guiding device may be quickly detached for manual operation in case of emergency or power failure, may be fitted to vertical or horizontal opening pre-existing window/door, may be combined with window blinds or shades (roller shades, vertical blinds, horizontal blinds), and may be fitted without obstruction to pre-installed blinds or shades. In one embodiment, the sliding opening systems may be controlled using smart speakers like Amazon Alexa™, Google Home™ Apple HomePod™, etc. as well as any internet connected device like cellphone, tablet, computer, and like devices. Alternatively, automatic sliding opening system may be controlled using security alarm systems, smart thermostats, fire alarms, smart door locks, smart garage door openers, cameras with motion detection etc. The guiding device may use any wireless and/or wired connection to communicate to other devices, hub, sensors and servers in a local network and/or to internet connected servers and devices. The guiding device may be operated remotely from anywhere by a user with internet or any other network connection with an authorized secured access. It will be appreciated by a person with ordinary skill in the art, in light of and in accordance with the teachings of the present invention, that there may be multiple options to operate device remotely. Suitable options include, but may not be limited to (i) user operation using infrared or wireless remote control device by pressing buttons on remote control device, for example, remote controllers similar to that used for a television set or a cable box; (ii) device connected to a local network using wired or wireless connection wherein the device may be operated using any other device in same local network using an interface from an application or a web browser with user commands; (iii) a device connected with internet using Wi-Fi or any other wireless interface or any central hub wherein the device may connect with a remote server/cloud via a secured channel to a user account on the server/cloud. The user may connect to the server/cloud via an application or web browser with secure login and send control commands to a device over the internet; (iv) similar to (iii) device, i.e. a device connected to a server/cloud, but controlled from another device. For example, instead of having a secure user login from an application or web browser, other smart devices like Google Home, Amazon Alexa, Apple HomePod, etc. may be connected with the device server/cloud with an authorized user access. In an exemplary embodiment, the smart devices may be enabled to send control commands to the device based on user configured events or direct user commands to other smart devices.

The present invention will now be described in detail with reference to embodiments thereof as illustrated in the accompanying drawings.

FIG. 1 is a front view of an exemplary sliding window/door system 10, in accordance with an embodiment of the present invention. In the present embodiment shown, sliding opening system 10 may include a door/window 11, a door/window frame 1, a horizontal sliding door/window panel 2 with right side opening, a fixed door/window panel 3, a deadbolt/latch 7 inbuilt in the door/window, a bottom mounted guiding device 20, a guiding device housing 19, a combination of at least one of the following including, but not limited to, a motorized mechanism/lead screw 18 and a sensors/circuit 16, a guide/control block 21, and attachment mechanism 22, 23, 24. The door/window frame 1 may be secured in a wall comprising of moving and fixed parts. In one embodiment, the door/window frame 1 may contain guide channels 8 for a movable panel 2 and holds a fixed panel 3. In various embodiments, the movable panel 2 opens or closes while sliding horizontally or moving vertically on frame 1 guide channels 8. The fixed panel 3 of the door/window may be attached to frame 1. The deadbolt or latch type lock 7 may be inbuilt in a majority of sliding door/ window to block movable panel 2 opening from outside when in a closed and locked position. The deadbolt 7 may be kept in an unlocked position to let the movable panel 2 be controlled with device 20 and attached with guide block 21. The deadbolt or latch type lock 7 may serve the functionality of a deadbolt/latch when movable panel 2 is closed and attached with guide block 21, thereby keeping the deadbolt/latch in an open position. In an exemplary embodiment, as mentioned hereinabove, the guiding device 20 may comprise a motorized mechanism similar to the mechanism shown in FIG. 18 including a lead screw and/or other modules like circuits, a power source, and sensors to generate the force necessary to move the movable panel 2. The guiding device 20 may move the guide block 21 back and forth along the length of the device. Force may be transferred via the guide block 21 to the movable panel 2 via various parts in between. The guide block 21 may be coupled to the motorized mechanism inside guiding device 20. When the motor rotates, it moves the guide block 21 back and forth based on a direction of rotation of the motor.

In some embodiments, the attachment mechanism 22, 23, 24 may comprise a pin implement 22, a hole portion 23, and a mounting face plate implement 24. In one embodiment, the pin implement 22 and the mounting face plate implement 24 may be disposed on a side corner of the movable panel 2. While the hole portion 23 may be disposed in the guide block 21 where the movable panel 2 may be detached and/or attached with the pin implement 22 that is pushed or pulled by hand. In another embodiments, the pin implement 22 and mounting face plate implement 24 may attached on the guide block 21 while the hole portion 23 may be disposed in a side corner of the moving panel 2 wherein the movable panel 2 may be detached and/or attached with the pin implement 22 that is pushed or pulled by hand. In one embodiment, there may be a string 31 used for a top mount option of the guiding device 20, to detach and/or attach the movable panel 2, instead of physically contacting pin implement 22 or guide block 21 (as explained in detail with reference to FIG. 12 hereinbelow.

In another embodiment, the guide block 21 may have a male/female or pin/hole mechanism that may be used to attach and detach the guide block 21 from the movable panel 2. The guide block 21 may be easily detached from or attached to the movable panel 2 manually. When operating in a detached or manual mode, the movable panel 2 may be moved freely by hand. In an attached or automatic operating mode, the movable panel 2 may be moved only if the guide block 21 moves due to motor rotation. The pin implement 22 and the mounting faceplate 24 may connect the guide block 21 to the movable panel 2. The pin implement 22 may be part of the attaching mechanism that is configured to transfer force from the guide block 21 to the movable panel 2. The hole portion 23 may be another part of the attaching mechanism that is configured to transfer force from the guide block 21 with pin 22 to the movable panel 2. A hole made on movable panel 2 as another option in attaching the guide block 21 with the movable Panel 2. This hole may be used without a mounting faceplate 24 if the guide block 21 mechanism is handled by the hole on movable panel 2. This helps to make the guide block 21 attach and detach function properly. The mounting faceplate 24 is part of the attaching mechanism that helps to hold other parts of the mechanism like the pin implement 22 and/or hole portion 23 to secure on movable panel 2. This handles force generated by the Guide block 21. The mounting faceplate 24 may be attached to the movable panel 2 with commercial grade glue or screws. In alternate embodiments, the mounting faceplate 24 may be attached anywhere on the movable panel 2 after aligning the guide block 21 moving direction with the movable panel 2. Glue or adhesive attachment may help to maintain warranty of a window as it does not need any cutting or drilling on the movable panel 2. The mounting faceplate 24 may help to make the guide block 21 attach and detach properly.

In other embodiments, the guiding device, i.e., control block guiding/operating device 20 may be mounted at a bottom portion of the horizontal operating panel 2 of the door/window 11. The guide block, i.e., control block 21 may be attached on a corner of horizontally movable panel 2. Control block 21 may also be fixed to guiding device 20, so as force can be transferred from guiding device 20 to control block 21 and finally to the operating panel 2. In various embodiments, there may be any type of male and/or female mechanism or latch mechanism on any of the side of guide block 21 so that it may be attached and/or detached from the guiding device 20 and/or horizontal moving panel 2. A latching or attachment mechanism may comprise of a pin implement 22, a hole portion 23 and/or a mounting face plate 24 combinations where the mounting face plate 24 and pin implement 22 may be engaged with the movable panel 2 and the guide block 21 may have a hole portion 23 for receiving the pin implement 22 and vice versa. In an exemplary embodiment, the guide block 21 may move to the left and/or right, and may also move the movable panel 2 with it. In one embodiment, the movable panel 2 and inbuilt deadbolt 7 may be in an open position when the guide block 21 is in an attached configuration with the movable panel 2. In another embodiment, when the guide block 21 is in an attached configuration with the movable panel 2, only the guide block 21 may move the movable panel 2 wherein the attached configuration may serve as the lock. In an exemplary embodiment, the deadbolt 7 may be disposed on a center section of the movable panel 2. In another embodiment, the deadbolt 7 may be disposed on any side along a length of the movable panel 2.

Figure 2:
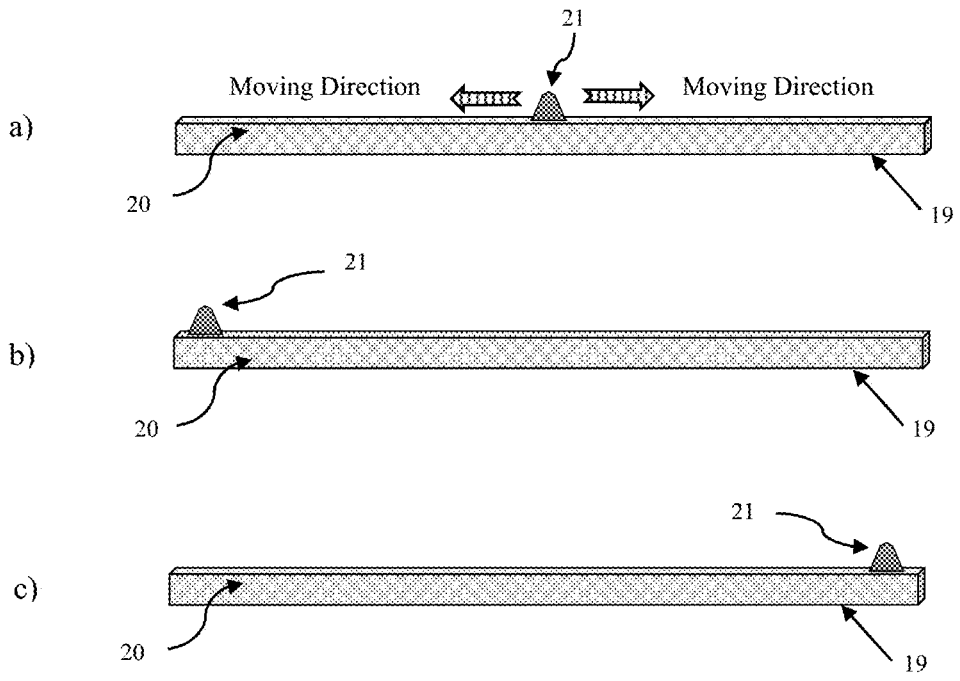
FIG. 2 is an illustration of an exemplary guiding system, in accordance with an embodiment of the present invention.

FIG. 2 is an illustration of an exemplary guiding device, i.e., control block guiding device 20, in accordance with an embodiment of the present invention. In the present embodiment shown, in a), a guide/control block 21 may be moved anywhere along the width of the door/window 11, illustrated by way of example in FIG. 1, with the Guiding device 20. In b) and c), a moving range for the guide block 21 at one of the sides may be more, less or same as a width of the guiding device 20 depending on an internal design of the guiding device 20. In one embodiment, the guiding device 20 may comprise a housing 19 in which a motorized mechanism may be housed along with other modules including, but not limited to, an actuator, circuits, a power source, and sensors to generate a force necessary to move the movable panel 2, illustrated by way of example in FIG. 1. The guiding device 20 may move the guide block 21 back and forth along the length of the guiding device 20. Force is transferred via guide block 21 to the movable panel 2 via various parts in between. In an exemplary embodiment, the guiding device 20 may comprise housing 19, and an inside mechanism similar to the mechanism shown in FIG. 18 including a small motor (with or without gears) which rotates a lead screw. In this embodiment, the guide block 21 may be attached on the lead screw and with motor rotation the guide block 21 moves horizontally across the length of the guiding device 20. It will be appreciated by a person with ordinary skill in the art, in light of and in accordance with the teachings of the present invention, that the inside mechanism may include any suitable linear actuators including, but not limited to, a mechanical, a hydraulic, a pneumatic, or an electro-mechanical actuator. In various embodiments, the motor rotation may be actuated by some circuitry or manual and/or automatic switches. When the motor rotates in one direction, it moves the guide block 21 towards the left and when the motor rotates in another direction it moves the guide block 21 towards the right. The motor may be placed inside or outside of the guiding device 20 and may still operate the lead screw mechanism. A guide block 21 may have a movement range that may open and close the movable panel 2 in full or any position in between. In case of an obstruction along a path of the guide block 21 or a sliding range greater than the width of the movable panel 2 or the length of the housing 19, there may be load detection or range detecting sensors configured to stop the motor rotation so as not to cause any damage or injury. For example, as per the design of existing sliding door/window available in market, movable panel 2 opens to a range of about 50 percent of the width of the door/window. Thus, guide block 21, in an exemplary embodiment, may need to move only to arrange of about 50 percent of the width of the door/window. In another embodiment, for ease of installation and simplicity of design, the guide block 21 movement range may be less, more, or the same than the opening width of the door/window.

Figure 3:
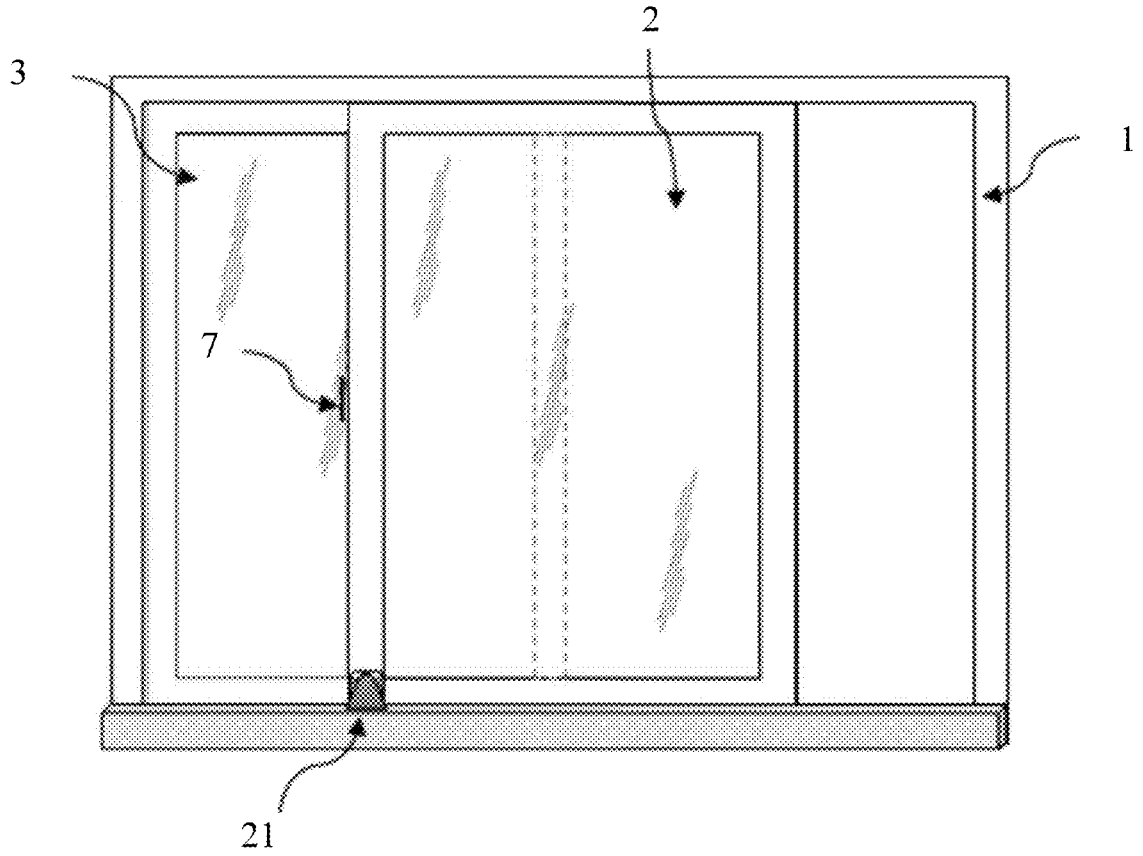
FIG. 3 is an illustration of an exemplary automatic sliding window/door system in auto mode, in accordance with an embodiment of the present invention.

FIG. 3 is an illustration of an exemplary sliding window/door system 10 in auto mode, in accordance with an embodiment of the present invention. As shown in FIG. 3, the horizontal sliding door/window panel 2 is opened mid-way with the guide block 21 in a latched position to moving the horizontal sliding door/window panel 2. The guiding device 20 may be controlled so that the moving panel 2 may be held along the length of the housing 19.

Figure 4:
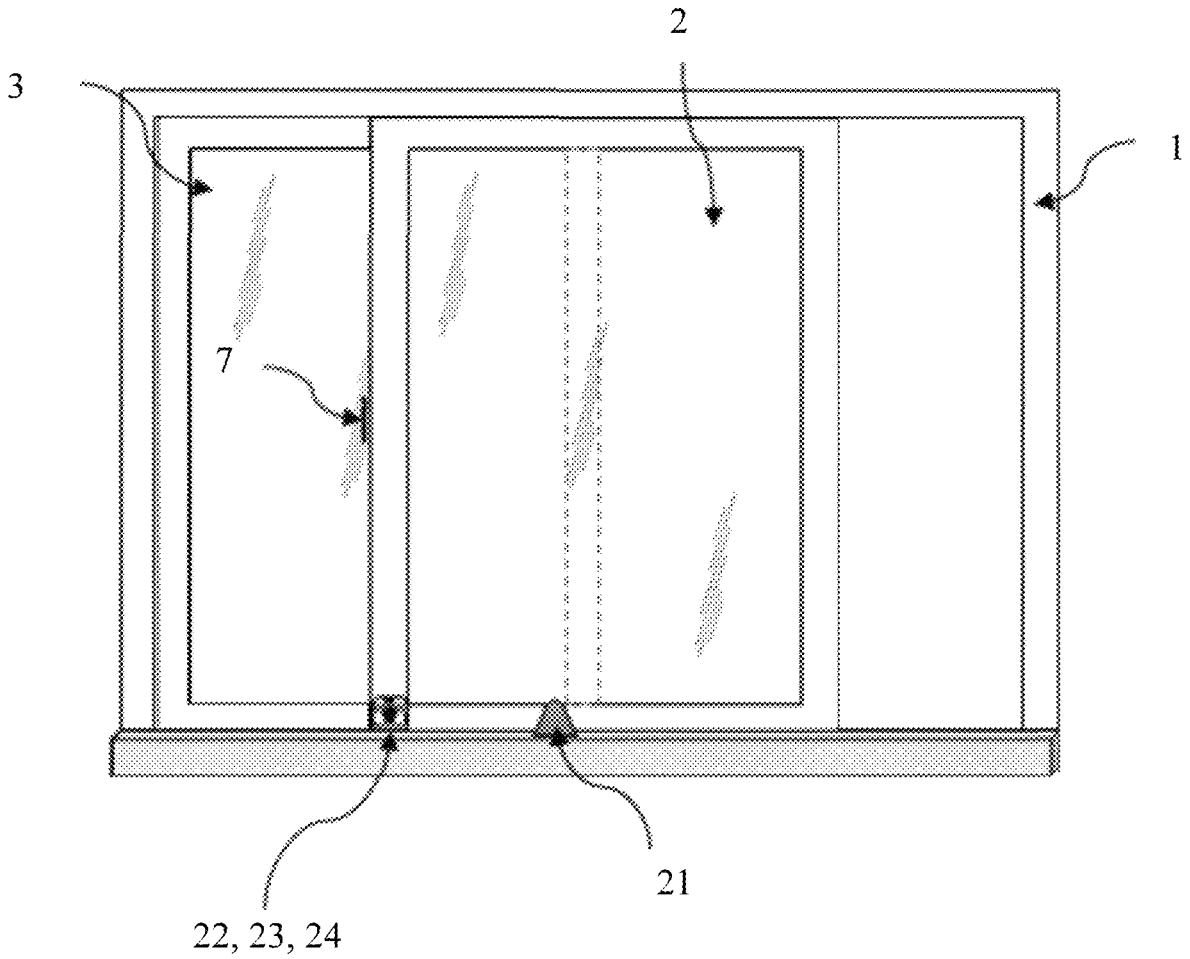
FIG. 4 is an illustration of an exemplary sliding window/door system in manual mode, in accordance with an embodiment of the present invention.

FIG. 4 is an illustration of an exemplary sliding window/door system 10 in manual mode, in accordance with an embodiment of the present invention. As shown in FIG. 4, the horizontal sliding door/window panel 2 may be opened mid-way manually, without the guiding device 20 operation. The pin implement 22, hole portion 23 or mounting plate implement 24 is detached from the guide block 21 for manual operation. The manual mode of operation enables a user to operate the movable panel 2 in case of power failure, malfunction or when automatic control is inaccessible. To operate in automatic mode, the movable panel 2 aligns to the guide block 21 position where the movable panel 2 may attach itself to the guiding device 20. Once the movable panel 2 is attached to the guiding device 20, the window panel 2 may resume operation in automatic mode.

Figure 5:
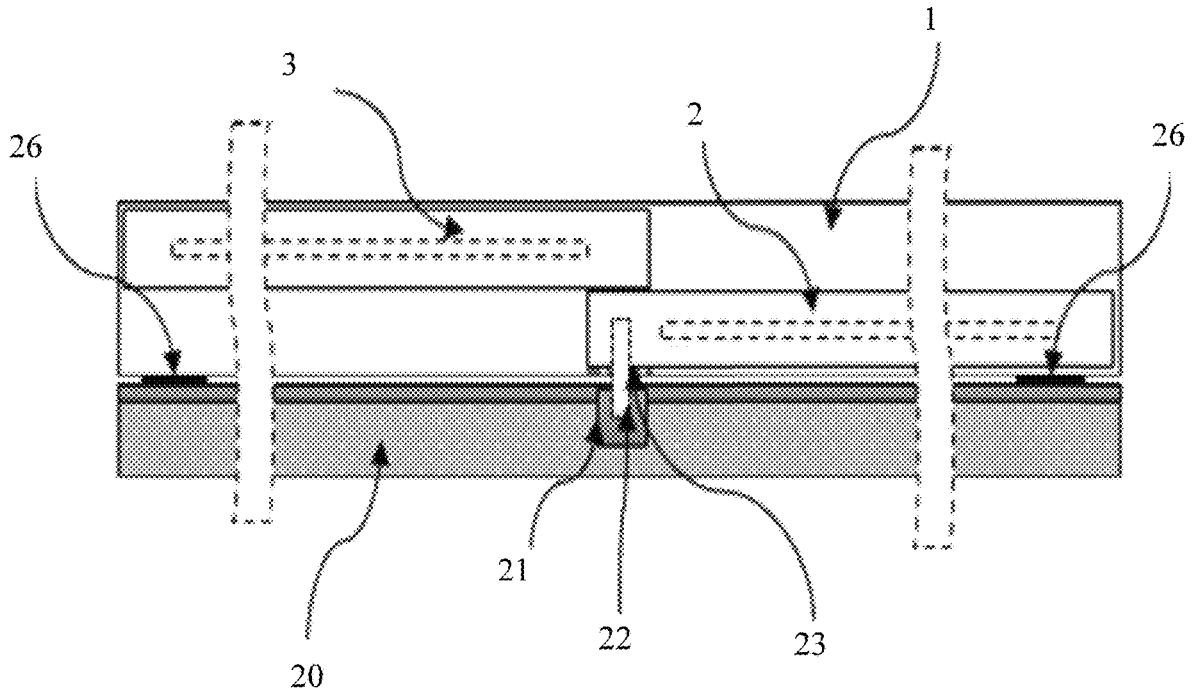
FIG. 5 is a top view of an exemplary guiding system, in accordance with an embodiment of the present invention.

FIG. 5 is a top view of an exemplary sliding window/door system 10, in accordance with an embodiment of the present invention. As shown in FIG. 5, the sliding window/door system 10 includes a door/window frame 1, a sliding door/window panel 2, a fixed door/window panel 3, mounting clamp/brackets 26, a guiding device 20, a guide block 21, a pin implement 22, and a hole portion 23. The mounting clamp/brackets 26 attach the guiding device 20 to the door frame of the sliding window/door system 10. The pin implement 22 is embedded in the guide block 21 which is coupled to the guiding device 20. The hole 23 is disposed on the movable panel 2. The [in implement 22 is coupled to the hole 23 which attaches the guide block 21 to the moving panel 2. The other segment of pin implement 22 is attached to a corresponding hole in the guide block 21. In alternative embodiments, the attachment mechanism may include, but not be limited to, hook and loop fasteners, hook and pile fasteners, touch fasteners, snap fasteners, plastic fasteners, metal fasteners, and the like.

Figure 6:
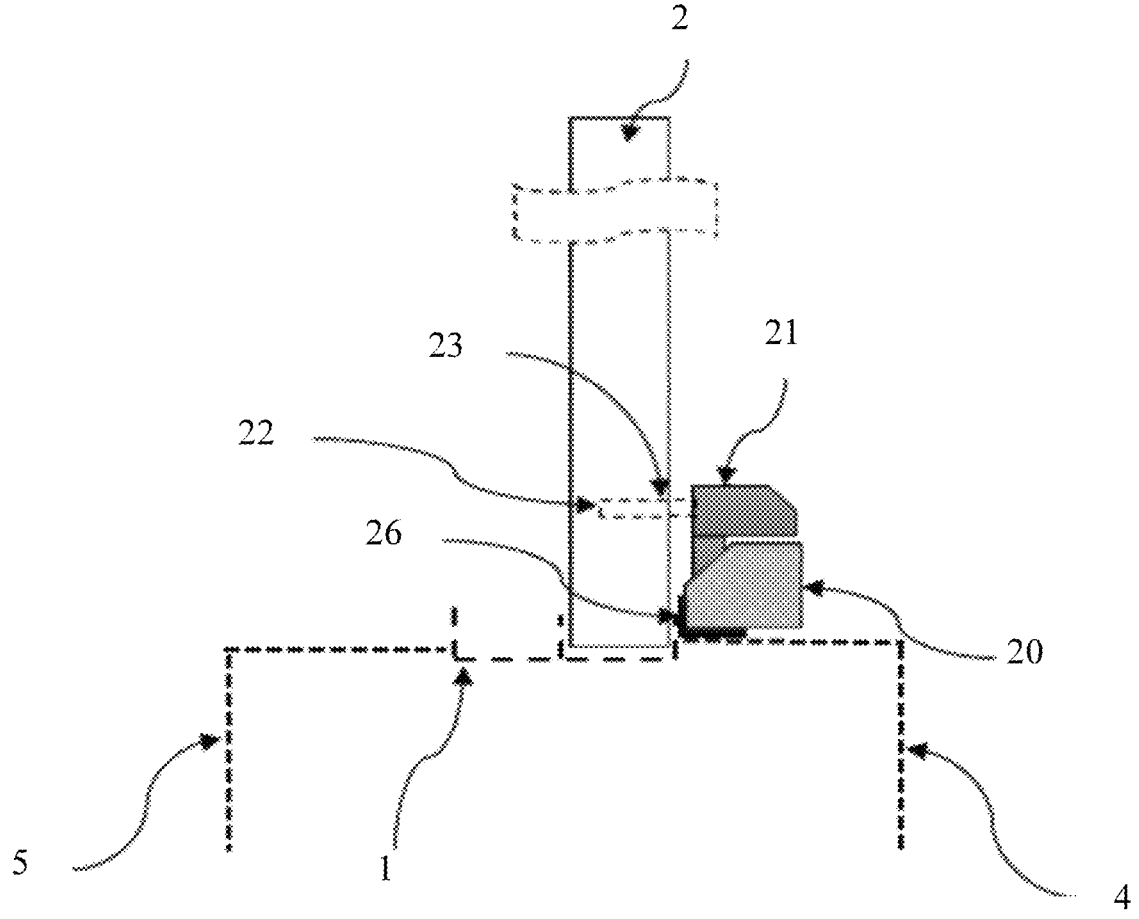
FIG. 6 is a side view of an exemplary guiding system, in accordance with an embodiment of the present invention.

FIG. 6 is a side view of an exemplary sliding window/door system 10, in accordance with an embodiment of the present invention. In the present embodiment, it is shown how the moving panel 2 is attached to the guide block 21 and it is shown how the sliding window/door system is installed against a wall surface. The illustration shows two window/door frame channels 1 fixed to the wall. The first frame channel facing towards the outside wall surface 5 hosts the fixed panel 3 while the second frame channel facing towards the internal wall surface 4 hosts the movable panel 2. The guiding device 20 is mounted adjacent to the window frame channel 1 with mounting clamps 26 on the internal wall surface. In one embodiment, the pin implement 22 is mounted in the guide block 21. The pin implement 22 may be self-latching or manually latched. The movable panel 2 comprises a corresponding hole 23 for the Pin implement 22 to insert. In this configuration, the movable panel 2 acts as a female block while the guide block 21 acts as a male block. This allows the force generated in the guide block 21 to be transferred to the movable panel 2.

Figure 7:
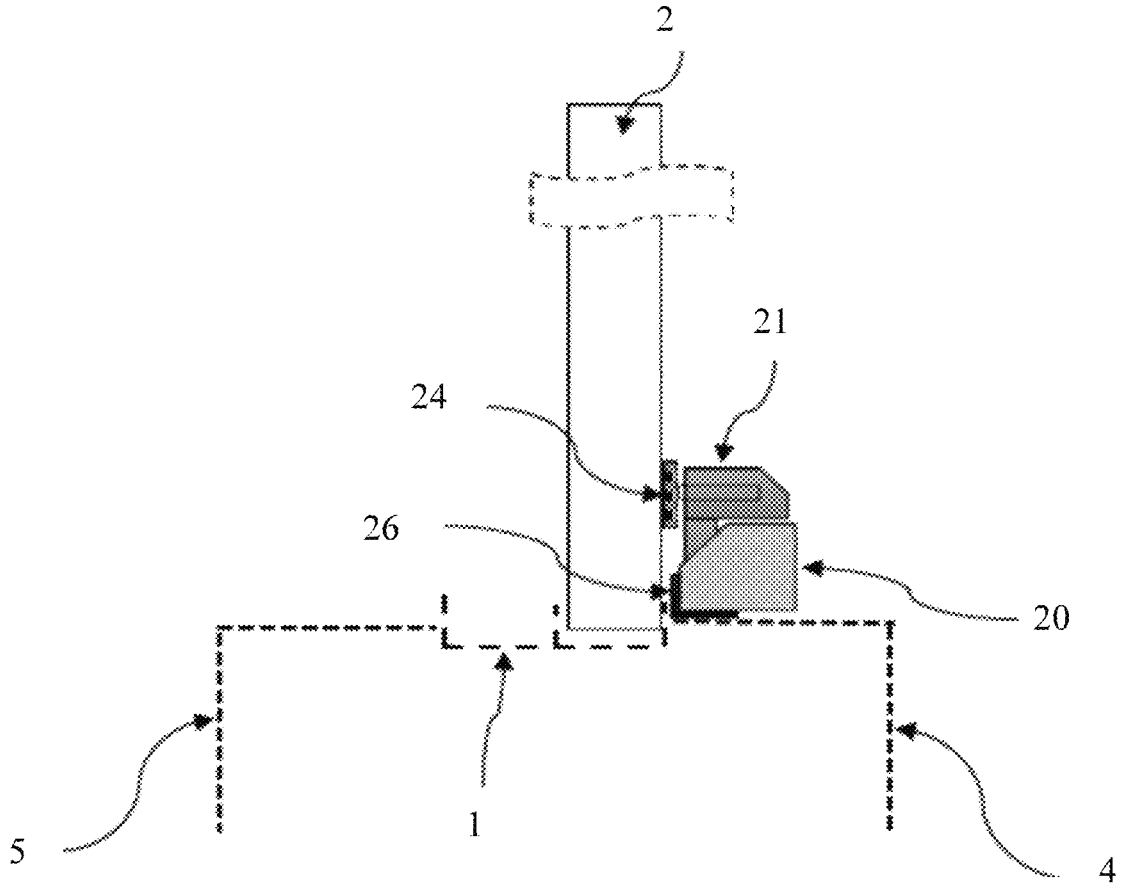
FIG. 7 is an illustration of an exemplary guiding system with mounting faceplate, in accordance with an embodiment of the present invention.

FIG. 7 is an illustration of an exemplary sliding window/door system 10 with mounting faceplate, in accordance with an embodiment of the present invention. In the present embodiment, it is shown how the movable panel 2 is attached to the guide block 21 and it is shown how the sliding window/door system is installed against a wall surface. The illustration shows two window/door frame channels 1 fixed to the wall. The first frame channel facing towards the outside wall surface 5 hosts the fixed panel 3 while the second frame channel facing towards the internal wall surface 4 hosts the movable panel 2. The guiding device 20 is mounted adjacent to the window frame channel 1 with mounting clamps 26 on the internal wall surface. In an alternative embodiment, a first end portion of the pin implement 22 is mounted in the moving panel 2 with a mounting faceplate 24. Suitable modes of engagements for the mounting faceplate 24 to the moving panel 2 include, but may not be limited to, adhesive pads, glue or screws, hooks and loops, snap latches, etc. The corresponding hole 23 for a second end portion of the pin implement 22 to insert, is hosted in the guide block 21. In this configuration, the movable panel 2 acts as a male block while the guide block 21 acts as a female block. The pin implement 22 may be self-latching or manually latched. This allows the force generated in the guide block 21 to be transferred to the movable panel 2. In other alternative embodiment, the attachment or engagement mechanism between the guide block 21 and the movable panel 2 may include, but not be limited to, magnetic, electric, solenoid, or a combination thereof.

Figure 8:
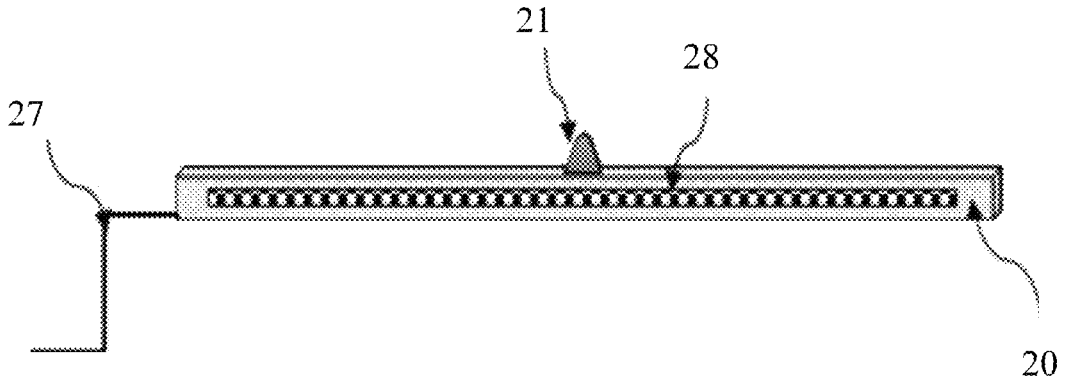
FIG. 8 is an illustration of an exemplary guiding system with wired power connection, in accordance with an embodiment of the present invention.

FIG. 8 is an illustration of an exemplary guiding device 20 with a wired connector, in accordance with an embodiment of the present invention. As shown in FIG. 8, the guiding device 20 may be coupled to an external power supply, charging device and/or device controller. The guiding device 20 may further include display screen of any size, LEDs, indicators, and/or control buttons 28 on any of the surface of the guiding device 20. Detectors including, but not limited to, glass break sensors, temperature sensors, humidity sensors, and/or pressure sensors may be mounted on the guiding device 20 that may either be visible or not visible on the device surface. The detectors may enable the guiding device 20 to provide security features such as, but not limited to, break-in detection.

Figure 9:
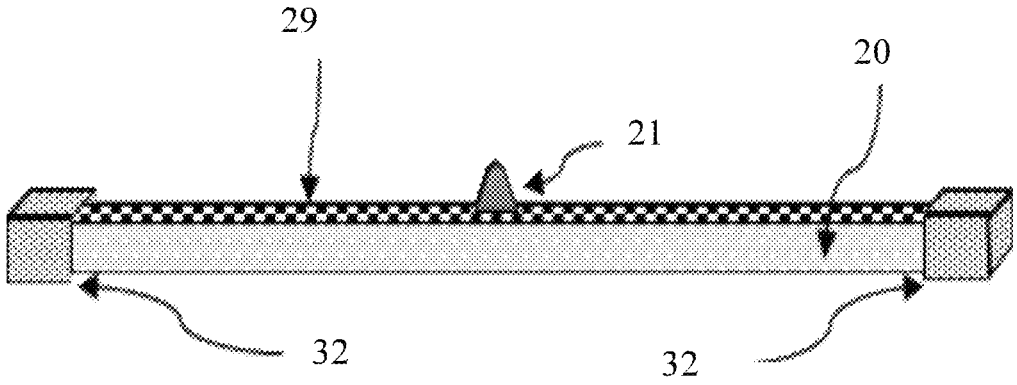
FIG. 9 is an illustration of an exemplary guiding system with solar panel, in accordance with an embodiment of the present invention.

FIG. 9 is an illustration of an exemplary guiding device 20 with solar panel, in accordance with an embodiment of the present invention. As shown in FIG. 9, the guiding device 20 may include solar panels 29 mounted on a top surface the guiding device 20, and corner/end caps 32 disposed on the end portions of the guiding device 20 for dimension adjustments and easy installation. The caps 32 may be used to adjust the device size within the width of the inside wall and hide the gap between side walls. The caps 32 may also be used to mount the guiding device 20 instead of the mounting clamp 26 mounted on the top surface (as shown in FIGS. 5, 6, and 7). Small solar panels 29 may be mounted on a surface of the guiding device 20. This can help to charge the guiding device 20 and avoid connecting power cord or recharge cable. Accordingly, in various embodiments, guiding device 20 may be powered with rechargeable or non-rechargeable batteries, wireless, solar or physically connected power cords.

Figure 10:
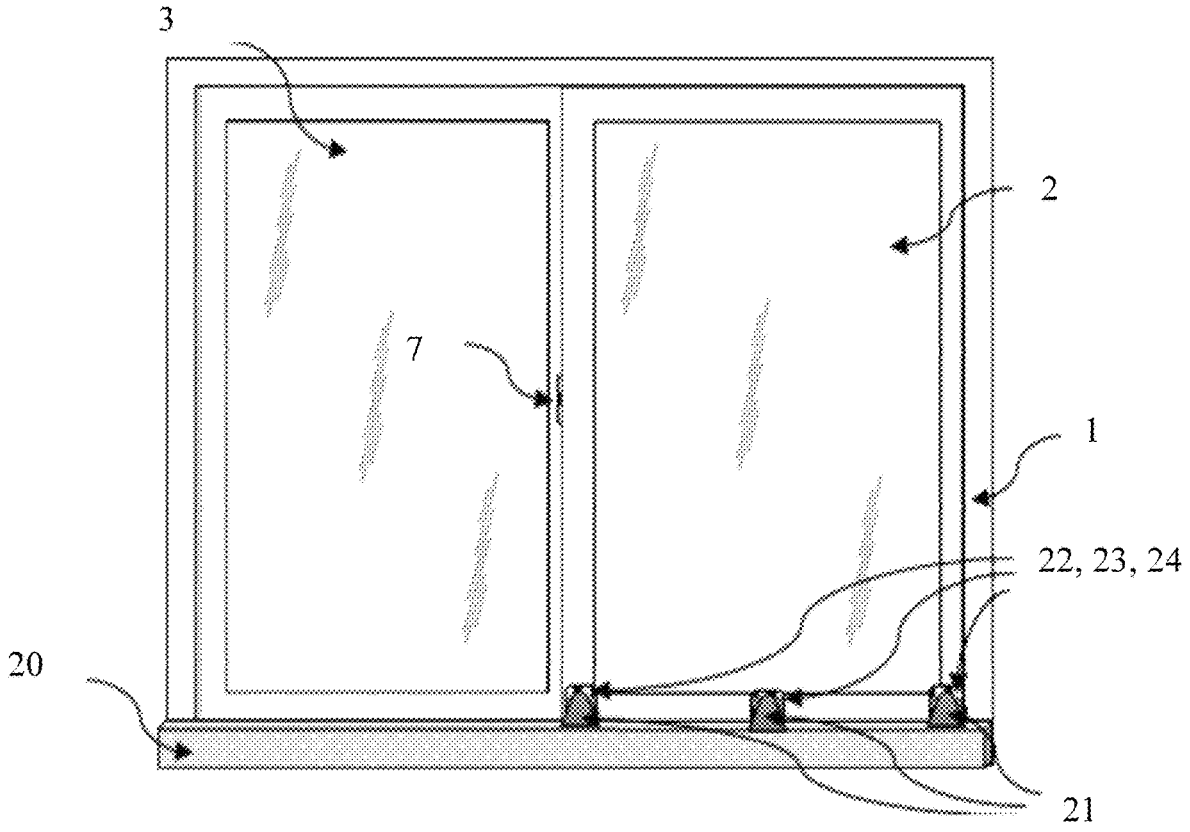
FIG. 10 is an illustration of an exemplary sliding window/door system, in accordance with an embodiment of the present invention.

FIG. 10 is an illustration of an exemplary sliding window/door system 10, in accordance with an embodiment of the present invention. In the present embodiment, the attachment mechanism 22 23 24 is shown installed in different locations of the moving door/window panel 2. The attachment mechanism 22 23 24 including mounting faceplate 24 or pin 22/hole 23, may be attached on any corner of or anywhere between the moving door/window panel 2. If using an adhesive with the mounting plate 24, the mounting plate 24 may be attached to the glass part as well instead of the frame.

Figure 11:
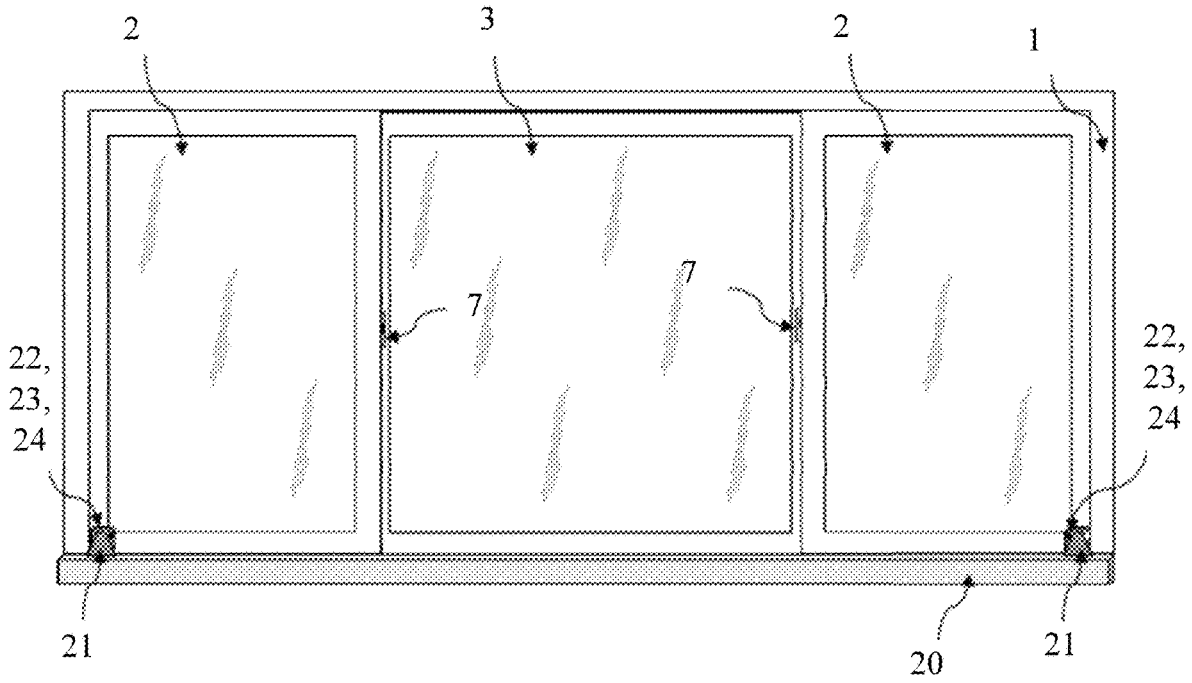
FIG. 11 is an illustration of an exemplary sliding window/door system with multiple panels, in accordance with an embodiment of the present invention.

FIG. 11 is an illustration of an exemplary sliding window/door system 10 with multiple window/door panels, in accordance with an embodiment of the present invention. In the present embodiment shown, system 10 may include a centrally fixed wide door/window 3 with two side moving panels 2. Each movable window/door panel 2 may be attached to a guide block 21 on a corner of each moving window/door panel 2 with attachment mechanism 22, 23, 24. The movable window/door panels 2 may be opened/closed individually or together. Deadbolt or latch type lock 7 may inhibit each of the moving window/door panel 2 being opened from outside when in a closed and locked position. In some embodiments, if the system 10 has multiple movable window/door panels 2, a guiding device 20 may have two guide blocks 21 that may operate individually or together. It will be apparent to those of ordinary skill in the art in light of and in accordance with the teachings of the present invention that a multiplicity of suitable configurations of guiding devices and guide blocks may be provided in various different embodiments. For example, without limitation, some embodiments may be configured as in FIG. 11 with one guiding device 20 with and two guiding blocks 21. Other embodiments may comprise two guiding devices with one guiding block 21 disposed on each guiding device.

Figure 12:
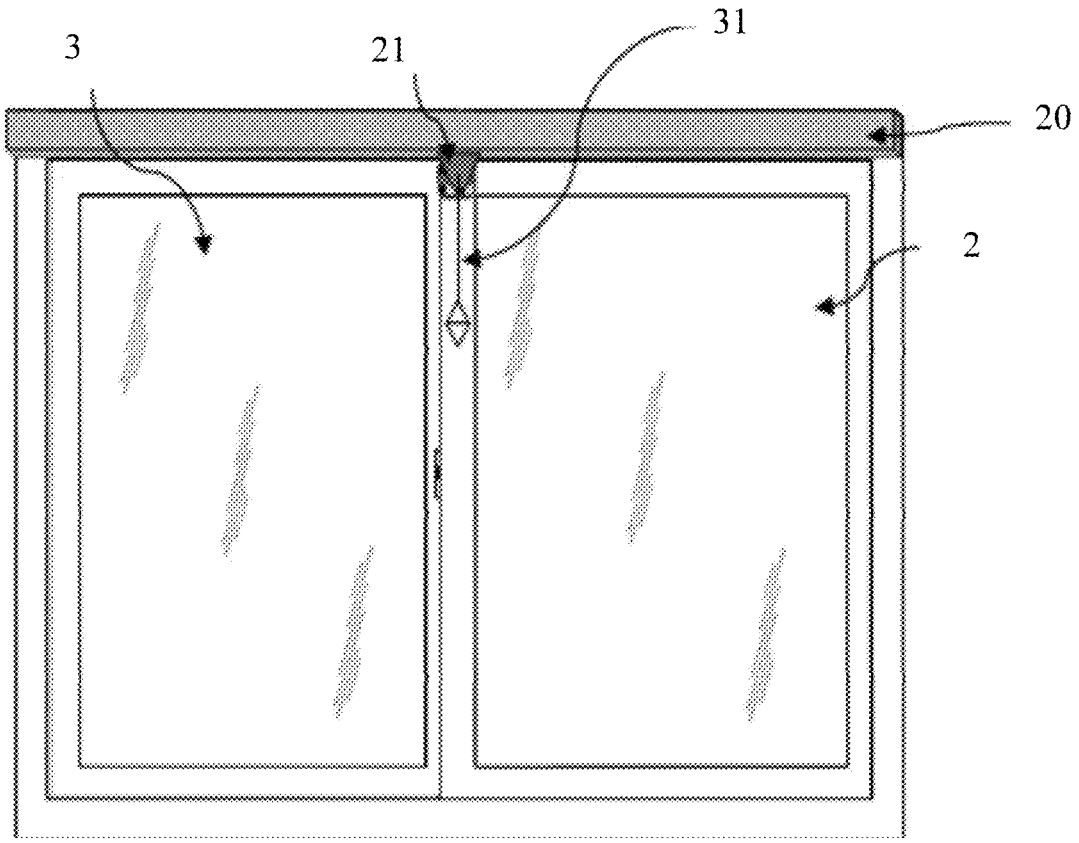
FIG. 12 is an illustration of an exemplary sliding window/door system with a top guiding system, in accordance with an embodiment of the present invention.

FIG. 12 is an illustration of an exemplary sliding window/door system 10 with a top guiding device 20, in accordance with an embodiment of the present invention. In the present embodiment shown, the guiding device 20 may be mounted at a top portion of a fixed door/window panel 3 and movable door/window panel 2. This mounting arrangement may be used if bottom mount is blocking the path or there is no room for installation at the bottom. This arrangement is more suitable for sliding patio doors where the guiding device 20 may be an obstruction in moving in or out if mounted at bottom. If the guide block 21 is not accessible for detachment, such as if the door/window height is too high, a string 31 may be attached to easily detach the movable panel 2 from the guiding device 20 or guide block 21.

Figure 13:
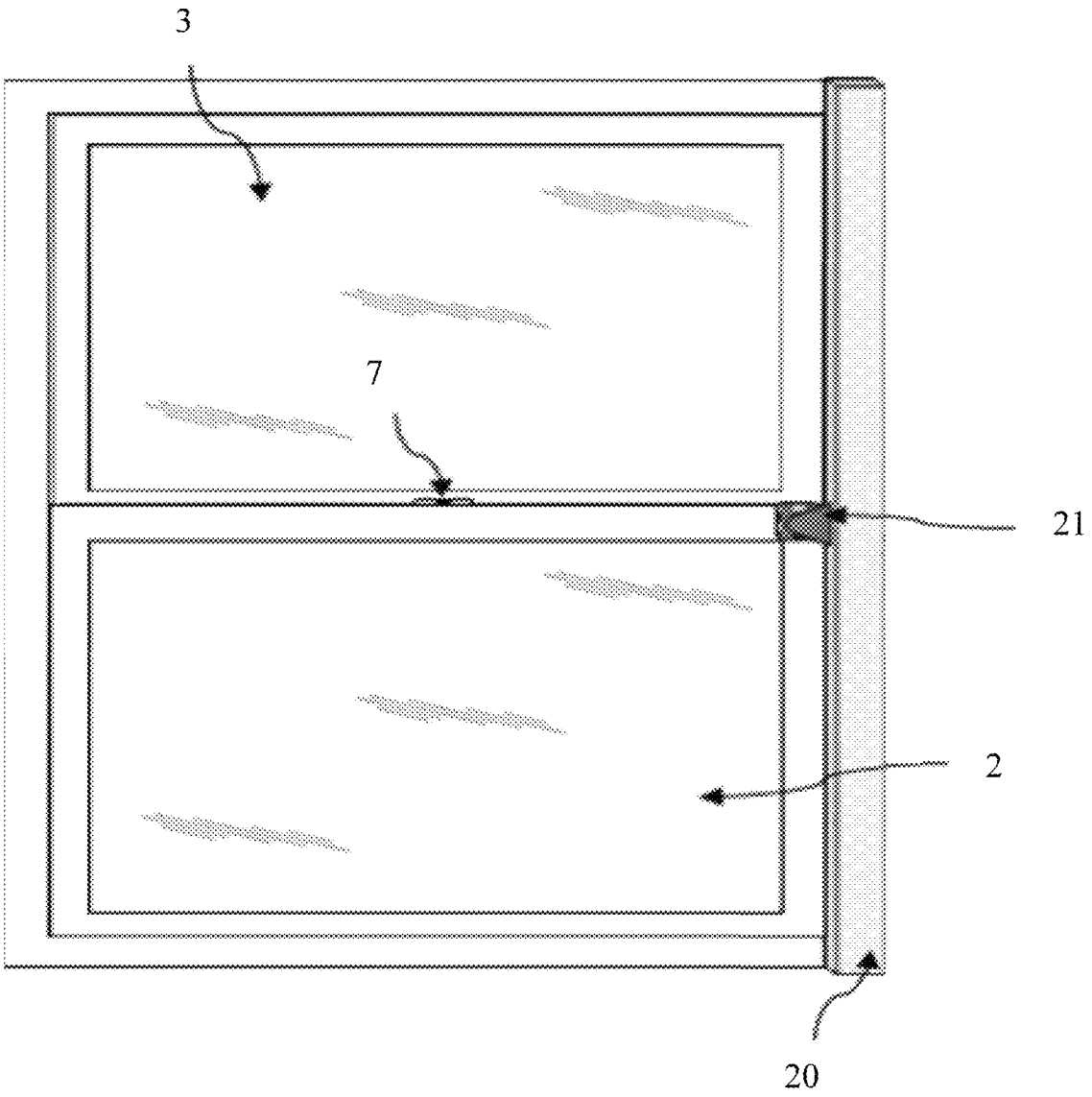
FIG. 13 is an illustration of an exemplary sliding window/door system with left side vertical guiding system, in accordance with an embodiment of the present invention.

FIG. 13 is an illustration of an exemplary vertical operating window system 10 with right side vertical guiding device 20, in accordance with an embodiment of the present invention. In the present embodiment shown, a vertical guiding device 20 may be mounted at a right-side portion of a fixed window panel 3 and a movable window panel 2. The fixed window panel 3 may be disposed at a top portion of the window system 10 and the movable window panel 2 may be disposed on a bottom portion of the window system 10 in a closed position. Springs or weights may be present inside window frame to hold the movable window panel 2 in a closed or open position and frame may not need any modification when the guiding device 20 is installed.

Figure 14:
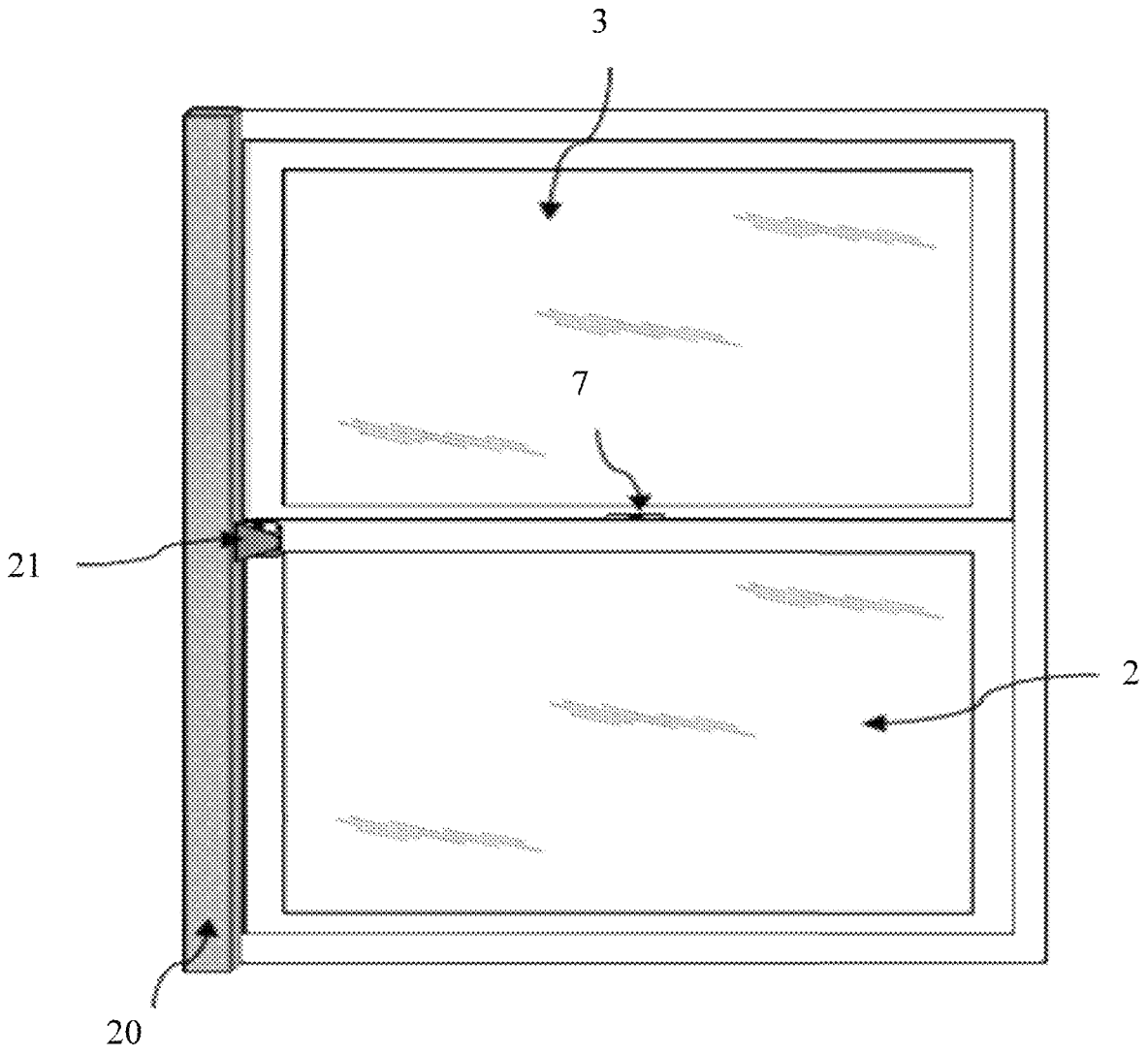
FIG. 14 is an illustration of an exemplary sliding window/door system with right side vertical guiding system, in accordance with an embodiment of the present invention.

FIG. 14 is an illustration of an exemplary vertical operating window system 10 with left side vertical guiding device 20, in accordance with an embodiment of the present invention. In the present embodiment shown, a vertical guiding device 20 may be mounted at a left side portion of a fixed window panel 3 and the movable window panel 2. The fixed window panel 3 may be disposed at a top portion of the window system 10 and the movable window panel 2 may be disposed on a bottom portion of the window system 10 in a closed position. Springs or weights may be present inside window frame to hold the movable window panel 2 in a closed or open position and frame may not need any modification when guiding device 20 is installed.

Figure 15:
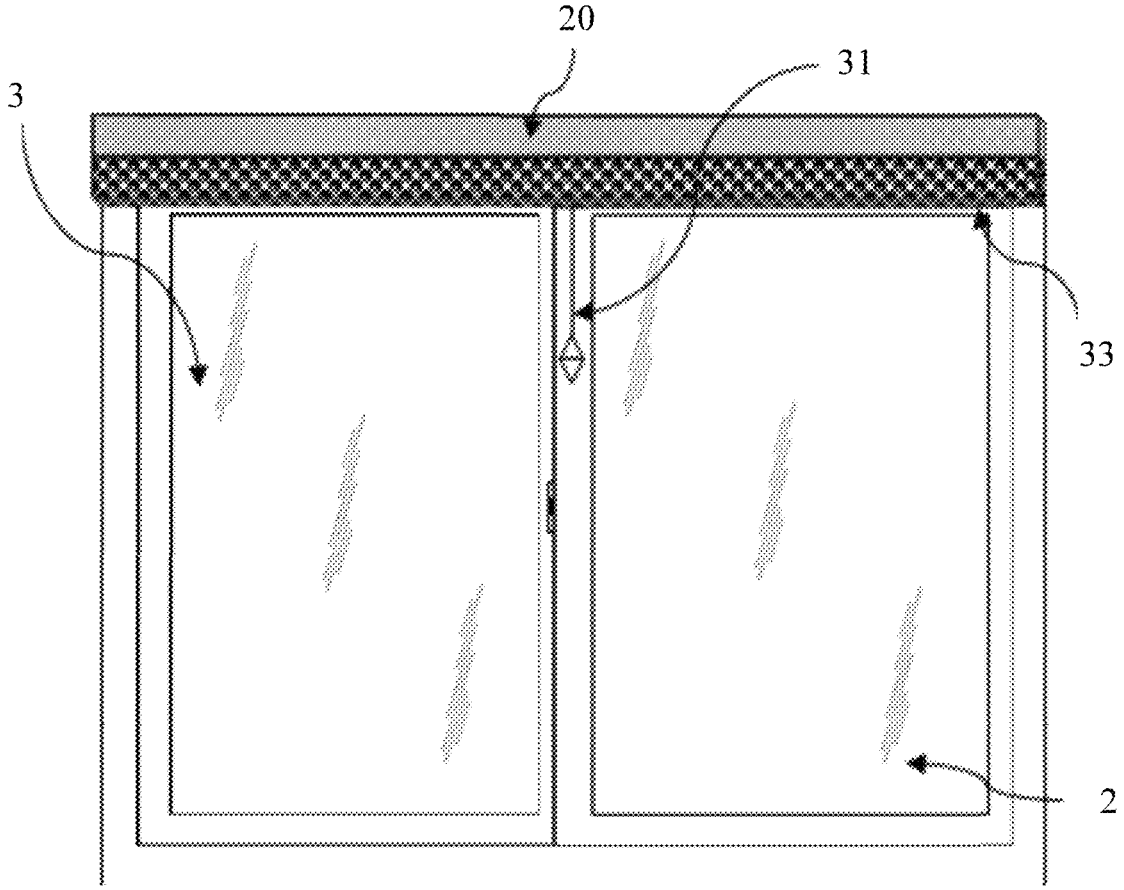
FIG. 15 is an illustration of an exemplary sliding window/door system with top guiding system with external blinds, in accordance with an embodiment of the present invention.

FIG. 15 is an illustration of an exemplary sliding window/door system 10 with blinds or shades, in accordance with an embodiment of the present invention. In the present embodiment shown, the guiding device 20 may be mounted at a top portion of a fixed door/window panel 3 and movable door/window Panel 2. This mounting arrangement may be used if bottom mount is blocking the path or there is no room for installation at the bottom. This arrangement is more suitable for sliding patio doors where the guiding device 20 may be an obstruction in moving in or out if mounted at the bottom. If the guide block 21 is not accessible for detachment, such as if the door/window height is too high, a string 31 may be attached to easily detach the movable panel 2 from the guiding device 20 or guide block 21. The guiding device 20 may hold mounting brackets of blinds/shades 33 on a surface or side of the guiding device 20. This way, the guiding device 20 as well as the blinds/shades 33 may both be installed as top mount. The blinds/shades 33 may be attached to the guiding device 20 such that it may hide the guiding device 20 behind a frame of the blinds/shades 33.

Figure 16:
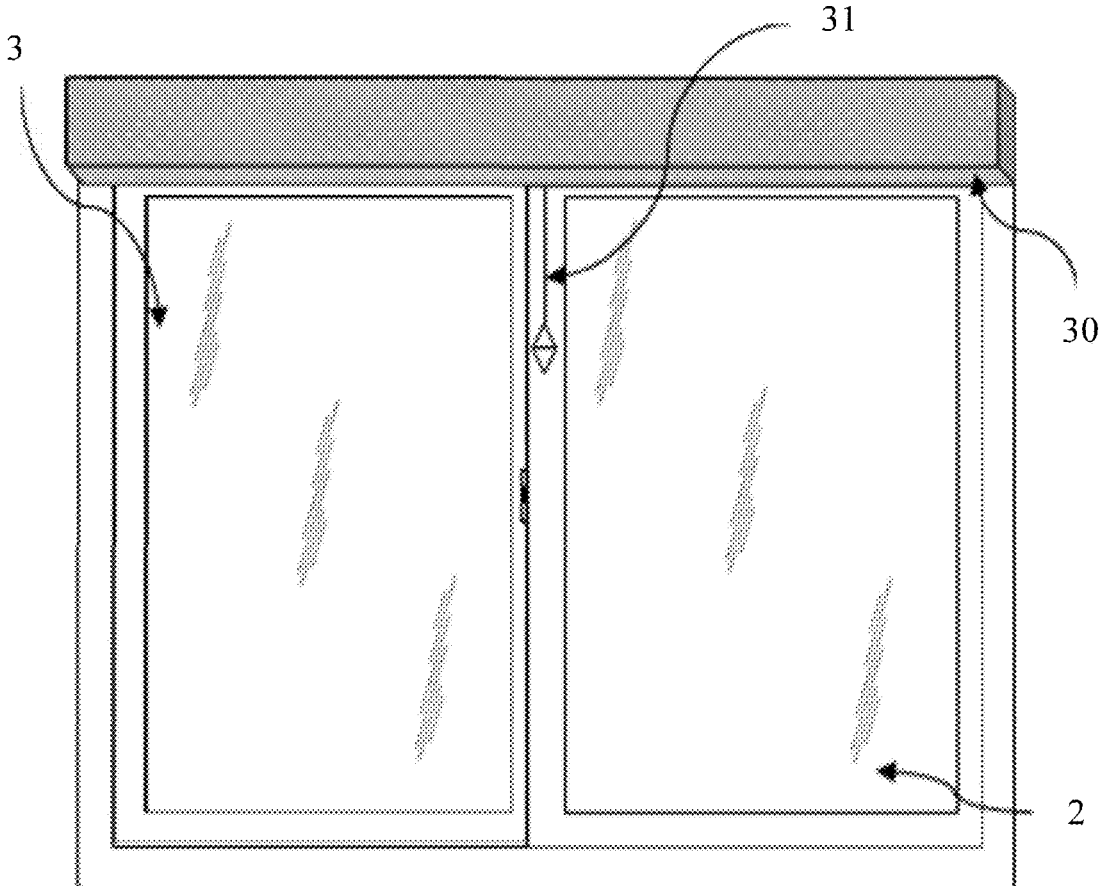
FIG. 16 is an illustration of an exemplary sliding window/door system with top guiding system integrating blinds, in accordance with an embodiment of the present invention.

FIG. 16 is an illustration of an exemplary sliding window/door system 10 with a top guiding device 20, in accordance with an embodiment of the present invention. In the present embodiment shown, the guiding device 20 may be mounted at a top portion of a fixed door/window panel 3 and movable door/window panel 2. The guiding device 20 may be combined with blinds/shades 33 as a single device 30. The combination guiding device and blinds/shades 30 may serve the function of opening/closing a movable door/window panel as well as opening/closing blinds/shades. Blinds/shades 33 may also include manual or automated varieties. If the guide block 21 is not accessible for detachment, such as if the door/window height is too high, a string 31 may be attached to easily detach the movable panel 2 from the device 30 or the guide block 21.

Figure 17:
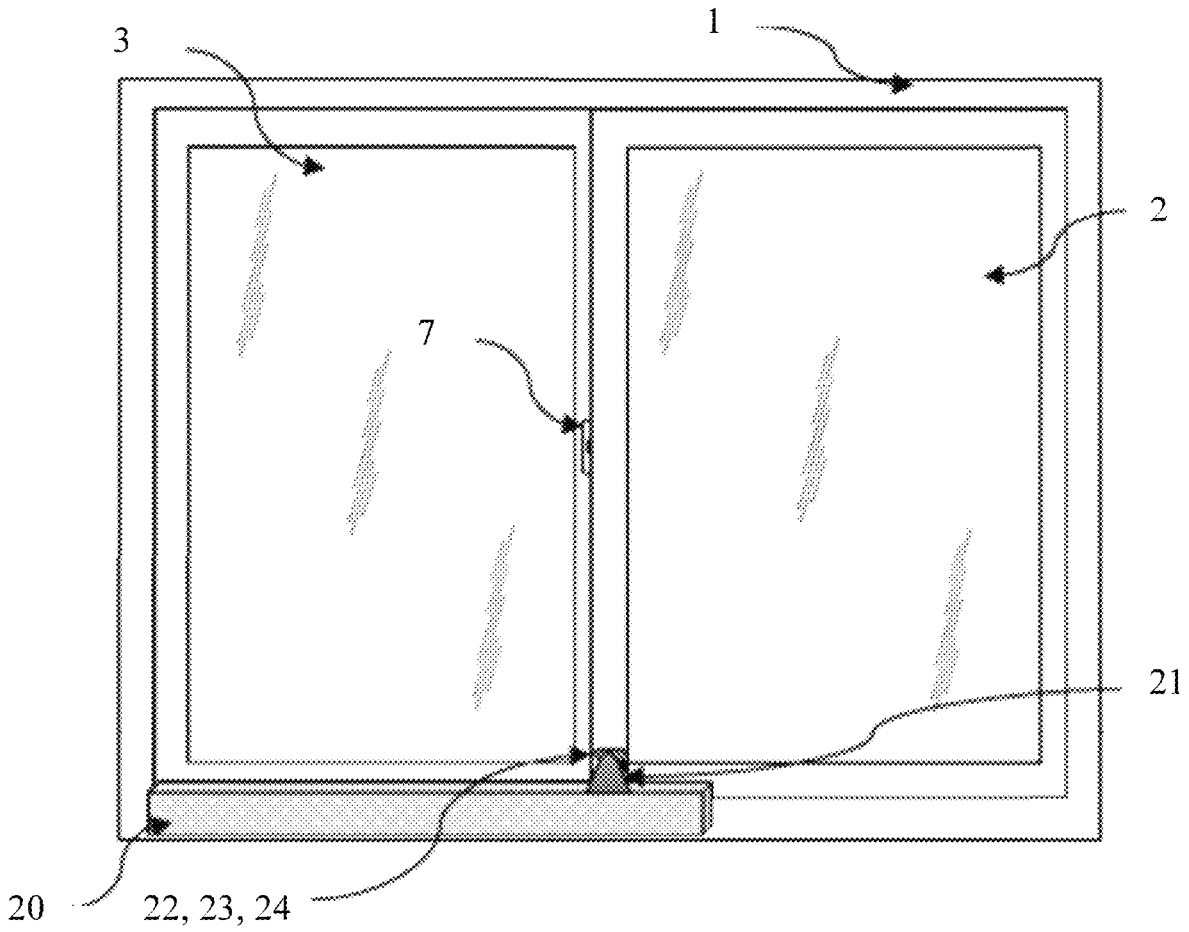
FIG. 17 is an illustration of an exemplary sliding window/door system with partial guiding system, in accordance with an embodiment of the present invention.

FIG. 17 is an illustration of an exemplary sliding window/door system 10 with a partial guiding device 20, in accordance with an embodiment of the present invention. In the present embodiment shown, the guiding device 20 may be smaller than a width of the fixed and movable door/window panels. In this case, the movable panel 2 may be moved lesser than a full range of sliding when attached with the guide block 21. This arrangement may be useful when the system functionality is needed without any visual appearance issue. The implementation of the partial guiding device 20 may reduce the cost of system and make regular size devices that may be fitted to wide door/window than the device size. Size adjustable end caps 32 may be used in this case to make guiding device 20 visually fit to the edges of the system.

Figure 18:
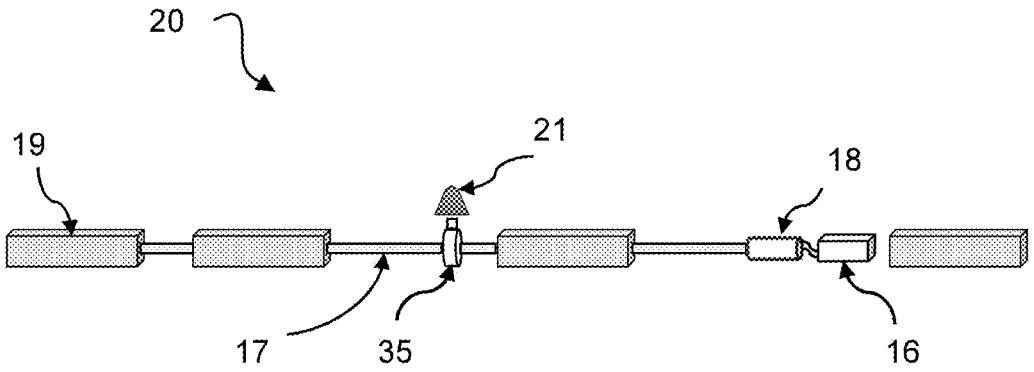
FIG. 18 is an illustration of an exemplary guiding device with a motorized mechanism inside, in accordance with an embodiment of the present invention.

FIG. 18 is an illustration of an exemplary guiding device 20 with a motorized mechanism 18, in accordance with an embodiment of the present invention. In FIG. 18, portions of the housing 19 are cut away to show the internal mechanisms. The guiding device 20 may comprise a motorized mechanism 18 including a lead screw 17, and/or other modules 16 such as control circuitry, a power source, and sensors to generate the force necessary to move the movable panel. A guiding actuator 35 placed inside housing 19 may move the guide block 21 placed outside back and forth along the length of the guiding device 20 when a lead screw 17 rotates in one or other direction. Force is transferred via the guide block 21 to the moving panel via the attachment mechanism. The guide block 21 may be coupled to the motorized mechanism 18 inside the guiding device 20. When the motorized mechanism 18 rotates, it moves the guide block 21 back and forth based on a direction of rotation of the motor.

Figure 19:
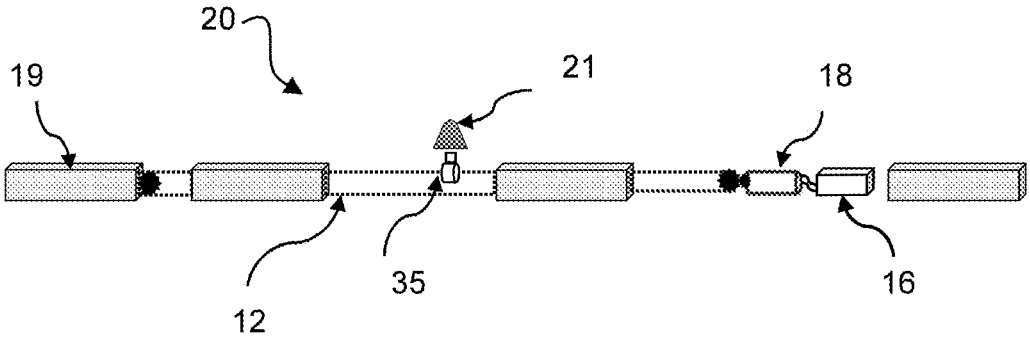
FIG. 19 is an illustration of an exemplary guiding device with a motorized mechanism inside, in accordance with an embodiment of the present invention.

FIG. 19 is an illustration of an exemplary guiding device 20 with a motorized mechanism 18, in accordance with an embodiment of the present invention. In FIG. 18, portions of the housing 19 are cut away to show the internal mechanisms. The guiding device 20 may comprise a motorized mechanism 18 with a belt or chain 12 and/or other modules 16 like control circuitry, a power source, and sensors to generate the force necessary to move the movable panel. The guiding actuator 35 connected to belt or chain 12 inside housing 19 may move the guide block 21 outside housing 19 back and forth along the length of guiding device 20 when belt or chain 12 rotates in one or other direction. Force is transferred via the guide block 21 to the movable panel via the attachment mechanism. The guide block 21 may be coupled to the motorized mechanism 18 inside the housing 19 of the guiding device 20. When the motorized mechanism 18 rotates, it moves the guide block back and forth based on a direction of rotation of the motor.

Figure 20:
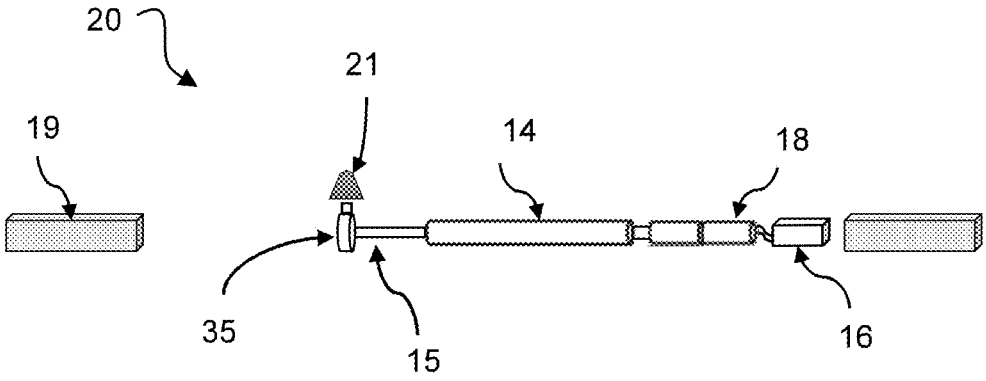
FIG. 20 is an illustration of an exemplary guiding device with a motorized mechanism inside, in accordance with an embodiment of the present invention.

FIG. 20 is an illustration of an exemplary guiding device 20 with a motorized mechanism 18, in accordance with an embodiment of the present invention. In FIG. 18, portions of the housing 19 are cut away to show the internal mechanisms. The guiding device 20 may comprise a motorized mechanism 18 with a hydraulic cylinder 14 and a piston mechanism 15 and/or other modules 16 like control circuitry, a power source, and sensors to generate the force necessary to move the sliding panel. The guiding actuator 35 connected to piston mechanism 15 inside the housing 19 may move the guide block 21 outside the housing 19 back and forth along the length of the guiding device 20 when the piston mechanism 15 expands or contracts with applied hydraulic pressure from hydraulic cylinder 14. Force is transferred via the guide block 21 outside to the movable panel via the attachment mechanism. The guide block 21 may be coupled to the motorized mechanism 18 inside the housing 19 of the guiding device 20. When the motorized mechanism 18 rotates, it moves the guide block 21 back and forth based on a direction of rotation of the motor.

It will be appreciated by a person with ordinary skill in the art, in light of and in accordance with the teachings of the present invention, that the inside of the guiding device may include any mechanism that may serve the purpose of opening and/or closing of the movable door/window shutter. FIG. 18, FIG. 19 and FIG. 20 included hereinabove provide three exemplary embodiments for the mechanism.

It will be appreciated by a person with ordinary skill in the art, in light of and in accordance with the teachings of the present invention, that the Material for frame or casing 19 may be made of any material including, but not limited to metal, vinyl, wood, ceramic, rubber, and a combination thereof. Additionally, in various embodiments, the outer casing 19 may be fabricated in any shape as long as it is capable of holding the internal parts described herein and they function in the required manner. Suitable shapes for the outer casing include, but are not limited to rectangle, cylindrical, and the like.

Those skilled in the art will readily recognize, in light of and in accordance with the teachings of the present invention, that any of the foregoing steps and/or system modules may be suitably replaced, reordered, removed and additional steps and/or system modules may be inserted depending upon the needs of the particular application, and that the systems of the foregoing embodiments may be implemented using any of a wide variety of suitable processes and system modules, and is not limited to any particular computer hardware, software, middleware, firmware, microcode and the like. For any method steps described in the present application that can be carried out on a computing machine, a typical computer system can, when appropriately configured or designed, serve as a computer system in which those aspects of the invention may be embodied.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant (s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing sliding window/door opening device according to the present invention will be apparent to those skilled in the art. Various aspects of the invention have been described above by way of illustration, and the specific embodiments disclosed are not intended to limit the invention to the particular forms disclosed. The particular implementation of the sliding window/door opening device may vary depending upon the particular context or application. By way of example, and not limitation, the automated window/door operating device described in the foregoing were principally directed to door and window implementations; however, similar techniques may instead be applied to, but not limited to, containers, boxes, etc, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A system comprising:

an opening comprising a door or a window, said door or said window including a frame, and at least one moveable panel;

a deadbolt disposed in the at least one moveable panel;

a guiding device, comprising a guiding actuator and a mechanical moving mechanism, wherein the mechanical moving mechanism comprises a load or range detection sensor configured to be operable for stopping a motor rotation to prevent damage or injury;

the guiding actuator and the mechanical moving mechanism are both housed in a guiding device housing;

said guiding device is configured to be operable for engaging the moveable panel, wherein the guiding device is powered with at least one of a battery, a wireless power source, a solar power source, and a power cord;

a guide block, wherein said guide block engages with the movable panel;

said guiding actuator is configured to be operable for moving the guide block back and forth along a length of the guiding device;

a motor, wherein the motor is configured to be operable for moving the guide block back and forth based on a direction of rotation of the motor;

an attachment mechanism, wherein said attachment mechanism comprises a pin implement, a hole portion, and a mounting face plate implement, wherein the pin implement and the mounting face plate implement are engaged with the guide block while the hole portion is disposed on a side corner of the moveable panel, wherein the moveable panel is detached or attached with the guide block by pushing or pulling the pin implement, which further includes a string amounted to the pin implement of the guide block and configured to be operable for engaging or disengaging the movable panel from the guiding device; and the attachment mechanism comprises at least one mechanism selected from a group consisting of a mechanical attachment mechanism, magnetic attachment mechanism, electric attachment mechanism, and solenoid attachment mechanism.

2. The system of claim 1, wherein the said door or said window further includes at least one fixed panel.

3. The system of claim 2, wherein the fixed panel is fixed to the frame.

4. The system of claim 1, wherein the mechanical moving mechanism comprises a motor device, a lead screw, a sensor, a power source, and a control circuitry.

5. The system of claim 1, wherein the mechanical moving mechanism comprises a belt-chain mechanism, a sensor, and control circuitry.

6. The system of claim 1, wherein the mechanical moving mechanism further comprises a hydraulic cylinder mechanism, a sensor, and control circuitry.

7. The system of claim 1, wherein the frame is secured in a wall.

8. The system of claim 1, wherein the frame includes guide channels to provide for movement of the at least one movable panel and provides support for at least one fixed panel.

9. The system of claim 8, wherein the movable panel opens or closes while sliding horizontally or moving vertically on the guide channels.

10. The system of claim 1, wherein the deadbolt is in an open position enabling the movable panel to be controlled with the guiding device when the movable panel is attached with the guide block.

11. The system of claim 1, wherein the pin implement and the hole portion of the attachment mechanism may be used to attach or detach the guide block from the movable panel.

12. The system of claim 1, wherein the guiding device is mounted on a bottom portion of the frame.

13. The system of claim 1, wherein the guiding device is mounted on a top portion of the frame.

14. The system of claim 1, wherein the guiding device is mounted on a left or right side portion of the frame.

15. The system of claim 1, wherein the guiding device operates in an automatic mode and the movable panel is moved only if the guide block moves due to a motor that forms a part of the mechanical moving mechanism.

16. A system comprising:

an opening comprising a door or a window;

said door or said window including a frame, and at least one moveable panel from a pre-existing door or window;

a deadbolt disposed in the at least one movable panel;

a guiding device, comprising a guiding actuator and a mechanical moving mechanism, wherein the mechanical moving mechanism comprises a load or range detection sensor configured to be operable for stopping a motor rotation to prevent damage or injury;

the guiding actuator and the mechanical moving mechanism are both housed in a guiding device housing;

said guiding device is configured to be operable for engaging said at least one moveable panel, wherein the guiding device is powered with at least one of a battery, a wireless power source, a solar power source, and a power cord;

a guide block, wherein said guide block engages with the movable panel and is configured to be operable for keeping the deadbolt in an open position;

said guiding actuator is configured to move the guide block back and forth along a length of the guiding device;

a motor, wherein the motor is configured to be operable for moving the guide block back and forth based on a direction of rotation of the motor; and an attachment mechanism, wherein said attachment mechanism comprises a pin implement, a hole portion, and a mounting face plate implement, wherein the pin implement and the mounting face plate implement are engaged with the guide block while the hole portion is disposed on a side corner of the moveable panel, wherein the moveable panel is detached or attached with the guide block by pushing or pulling the pin implement, which further includes a string mounted to the pin implement used to attach and detach the moveable panel from the guiding device.

17. A system comprising:

an opening comprising a door or a window;

said door or said window including a frame, and at least one moveable panel;

a deadbolt disposed in the panel;

a guiding device, comprising a guiding actuator and a mechanical moving mechanism, wherein the mechanical moving mechanism comprises a load or range detection sensor configured to be operable for stopping a motor rotation to prevent damage or injury;

the guiding actuator and the mechanical moving mechanism are both housed in a guiding device housing;

said guiding device is configured to be operable for engaging said at least one moveable panel, wherein the guiding device is powered with at least one of a battery, a wireless power source, a solar power source, and a power cord;

a guide block, wherein said guide block engages with the movable panel, and is configured to be operable for keeping the deadbolt in an open position;

said guiding actuator is configured to move the guide block back and forth along a length of the guiding device;

a motor, wherein the motor is configured to be operable for moving the guide block back and forth based on a direction of rotation of the motor;

an attachment mechanism, wherein said attachment mechanism comprises a pin implement, a hole portion, and a mounting face plate implement, wherein the pin implement and the mounting face plate implement are engaged with the guide block while the hole portion is disposed on a side corner of the moveable panel, wherein the moveable panel is detached or attached with the guide block by pushing or pulling the pin implement, which further includes a string mounted to the pin implement used to attach and detach the moveable panel from the guiding device; and the attachment mechanism comprises at least one mechanism selected from a group consisting of a mechanical attachment mechanism, magnetic attachment mechanism, electric attachment mechanism, and solenoid attachment mechanism.

* * * * *